US006678898B2

(12) United States Patent
Jones et al.

(10) Patent No.: US 6,678,898 B2
(45) Date of Patent: Jan. 20, 2004

(54) APPAREL BELT FASTENING TABS

(75) Inventors: Rodney L. Jones, Indianapolis, IN (US); Angela Jones, Indianapolis, IN (US)

(73) Assignee: Q-Life Incorporated Contact-Treva Weathers, Indianapolis, IN (US)

( * ) Notice: Subject to any disclaimer, the term of this patent is extended or adjusted under 35 U.S.C. 154(b) by 86 days.

(21) Appl. No.: 09/905,763

(22) Filed: Jul. 14, 2001

(65) Prior Publication Data

US 2002/0035746 A1 Mar. 28, 2002

Related U.S. Application Data

(60) Provisional application No. 60/223,096, filed on Aug. 3, 2000.

(51) Int. Cl.[7] ..... A41F 9/00

(52) U.S. Cl. ..... 2/321; 2/338

(58) Field of Search ..... 2/321, 322, 310–320, 2/235, 236, 338; 24/31 R, 580, 578.15, 182, 174

(56) References Cited

U.S. PATENT DOCUMENTS 2,681,453 A * 6/1954 Lane ..... 2/322
3,374,636 A * 3/1968 Mason ..... 2/312
4,173,794 A 11/1979 Nichols
4,179,755 A 12/1979 Clark
4,203,167 A 5/1980 Collins
4,715,839 A * 12/1987 Ford et al. ..... 2/300
5,309,575 A 5/1994 Lookhoof
5,519,893 A 5/1996 Silver
5,762,619 A * 6/1998 Simon ..... 2/312
5,797,171 A 8/1998 Nelson

OTHER PUBLICATIONS

U.S. patent application Ser. No. 461,432, Jones, filed 1999.
U.S. patent application Ser. No. 60/223,096, Jones, filed 2000.

* cited by examiner

*Primary Examiner*—Gloria M. Hale
*Assistant Examiner*—Tejash Patel

(57) ABSTRACT

Two elongated, flat, belt end-tabs (20) and (32) made of a material suitable for permanent attachment to opposite ends of a torso-encircling strap (38). The first said belt end-tab (20) having Velcro hook (28) material attached lengthwise to it's underside and, the second said belt end-tab (32) having Velcro loop (34) material attached lengthwise to it's topside. Said belt end tabs (20) and (32) being releasably attachable to each other in an overlapping fashion by the mating of said Velcro hook (28) and said Velcro loop (34). Said Velcro hook (28) being a predetermined length so that approximately one inch of the free end of said belt end tab (20) is left uncovered so that pull-grip (30) is formed. In addition, a belt buckle (22) is mounted to the first said belt end tab (20) by means of a buckle positioning hole (24) which gives the assembly the deceptive appearance of being fastened with a buckle.

2 Claims, 3 Drawing Sheets

APPAREL BELT FASTENING TABS

CROSS-REFERENCE TO RELATED APPLICATIONS

Figure 1:
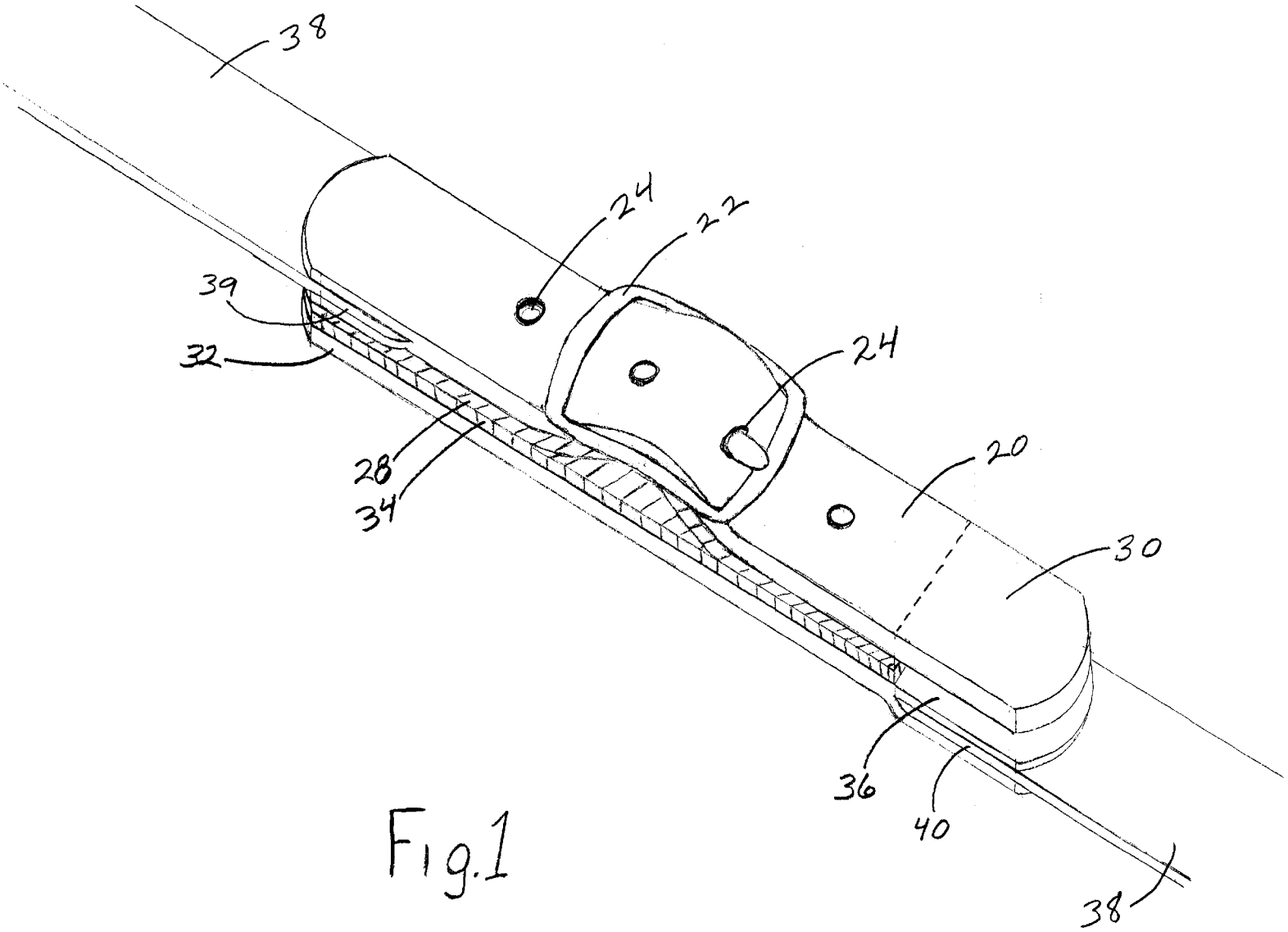

This application is entitled to the benefit of Provisional Patent Application Ser. No. 60/223,096, filed Aug. 3, 2000 and, Disclosure Document No 461432, filed Aug. 30, 1999.

BACKGROUND

1. Field of Invention

This invention relates to the clothing accessory commonly known as an apparel belt, and specifically, to those devices used to connect the opposite ends of a belt around the wearer's waist.

2. Description of Prior Art

Belts of various types are commonplace and have been used to hold up trousers for as long as pants have been worn. Generally, the opposite ends of a belt are fastened together to encircle the wearer's torso. The fastening is accomplished in a number of different ways; from the simple knot-in-a-rope to all sorts of buckles and clasps.

A common construction for apparel belts is where a leather end-tab is sewn to each end of a strap of webbing. A first end-tab has a buckle attached to it, and, a second end-tab has an aligned plurality of holes. The two end-tabs are fastened together by inserting the second end-tab through the buckle's opening, then, inserting the buckle's tongue through one of the holes. This action is known as "buckling" the belt and, conversely, unfastening and separating the two belt-ends is called "unbuckling".

For effective operation, each fastening method or device requires some degree of manual dexterity. The level of dexterity required to use the prior art described above presents difficulties for some people. In particular, very small children, the elderly, and those with conditions limiting hand and wrist mobility, can find using conventional belts cumbersome. Most belts on the market today were designed for the general population with apparently very little consideration for those with Special Needs.

SUMMARY

In accordance with the present invention a belt fastening assembly comprises two flat similarly shaped bodies, releasably attached to each other with Velcro in an overlapping fashion, and, a belt buckle mounted to the top overlapping body to give the assembly the deceptive appearance of being fastened with a buckle.

Objects and Advantages

Accordingly, several objects and advantages of the present invention are:

(a) Individuals with factors limiting their dexterity including the elderly, arthritis sufferers, stroke victims, wearers of prosthetic hooks and those with carpel tunnel syndrome, among many others, can unfasten our belt with less effort, than traditional buckle-fastened belts.

(b) Parents of toddlers can use the present invention as a pottie training aid as it allows their little one to open their belt all by themselves. The independence gained can help build confidence and self-esteem.

(c) Wetting accidents, and the associated embarrassment, can be reduced due to the quick release design. Most belts made for children were not designed for children. They are simply adult-styled belts made smaller.

(d) Many daycare providers follow a Hands-Off policy regarding children and restroom use, advising parents to ensure their child can remove and replace their own clothing. The present invention can make it easier for all to comply with applicable rules.

(e) The aforementioned individuals can appreciate and enjoy the discreet appearance and aesthetic value of a piece of adaptive equipment that looks just like a regular belt.

Further objects and advantages of this invention will become apparent from a consideration of the drawings and ensuing description.

DRAWING FIGURES

FIG. 1 The completed assembly fastened

Figure 2:
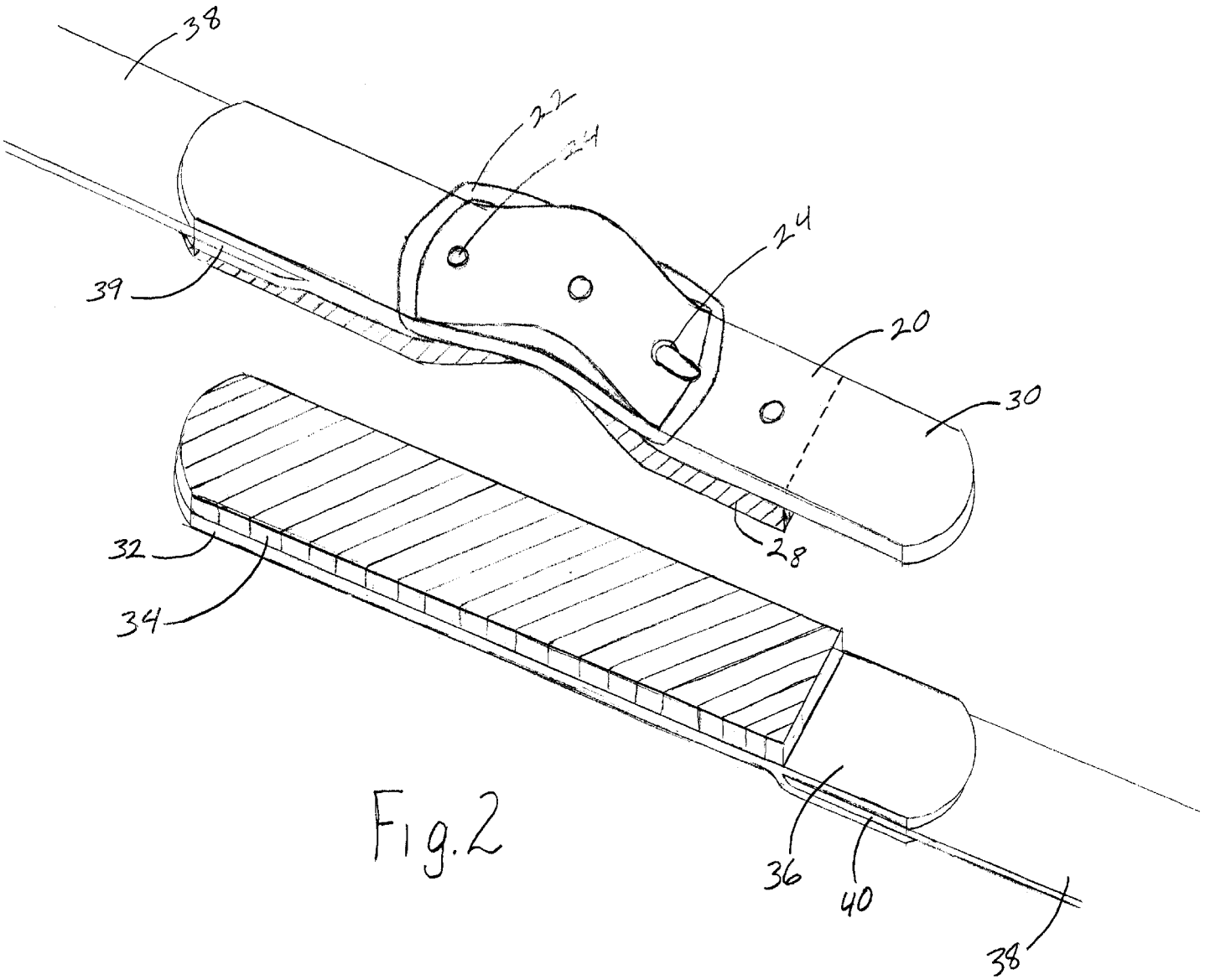

FIG. 2 The completed assembly unfastened

Figure 3:
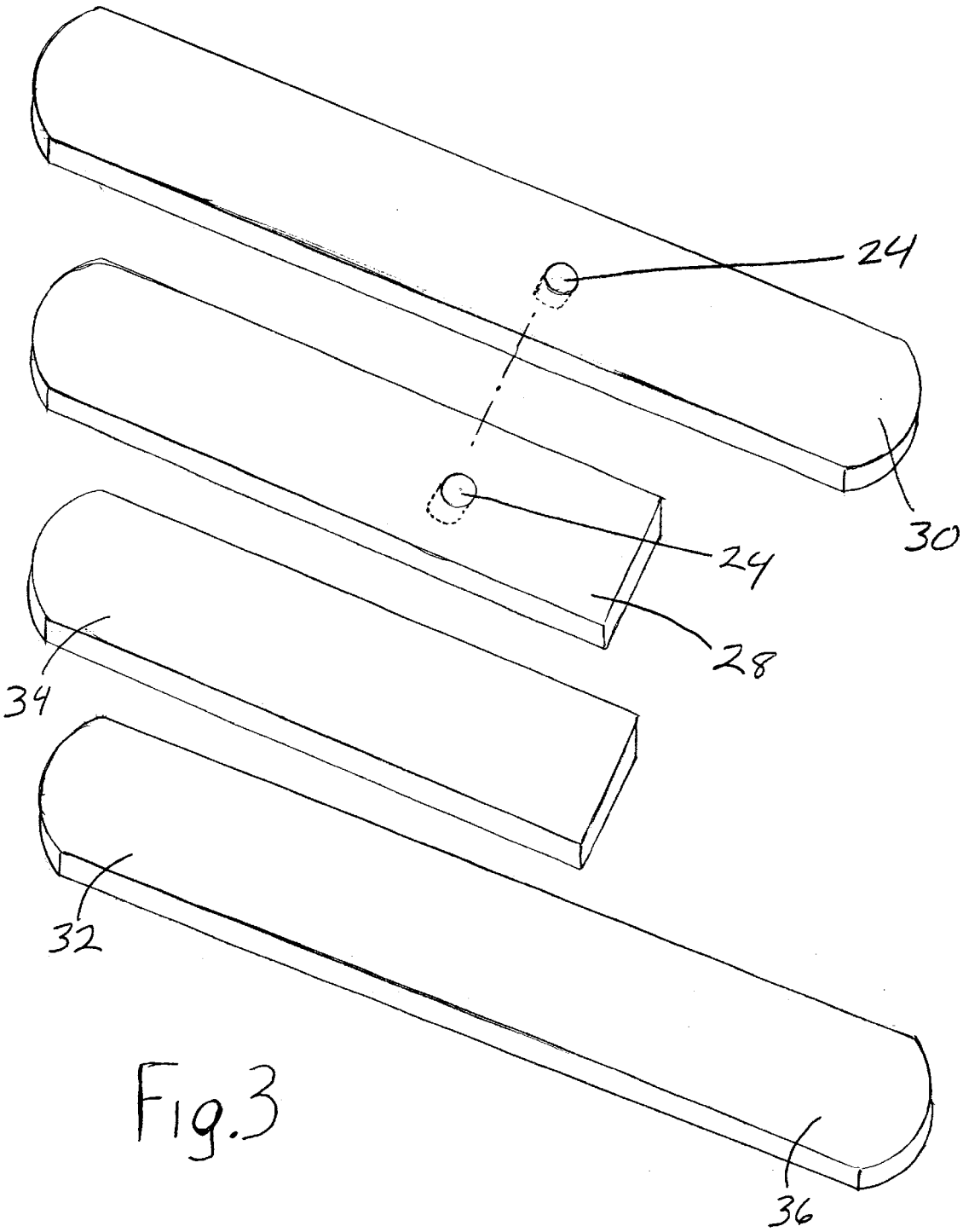

FIG. 3 An exploded view of the assembly without the buckle and strap

| Reference Numerals in Drawings | |
|---|---|
| 20 Front end-tab | 22 Buckle |
| 24 Buckle positioning hole | 26 Holes for appearance |
| 28 Velcro hooks | 30 Front tab pull-grip |
| 32 Rear end-tab | 34 Velcro loops |
| 36 Rear tab pull grip mate | 38 Torso-encircling strap |
| 39 Left strap-end | 40 Right strap-end |

DESCRIPTION—FIGS. 1, 2 & 3—PREFERRED EMBODIMENT

FIG. 1 shows a perspective view of a basic version of our belt fastener. The two main components of the belt fastener are an elongated front end-tab 20 and an elongated rear end-tab 32. One end of a torso-encircling strap 38 is permanently attached to the left end of front end-tab 20 and the other end of the same strap 38 is permanently attached to the right end of rear end-tab 32. FIG. 1 shows front end-tab 20 and rear end-tab 32 releasably attached to each other in an overlapping fashion. FIG. 1 also shows buckle 22 in place.

FIG. 2 shows a perspective view of our belt fastener in which front end-tab 20 and rear end-tab 32 have been separated by disengaging Velcro hooks 28 from Velcro loops 34. FIG. 2 also shows buckle 22 in place. Note that Velcro hooks 28 do not cover front end-tab 30 completely. This uncovered area forms front tab pull-grip 30. Note that Velcro loops 34 do not cover rear end-tab 32 completely. This uncovered area forms rear tab pull grip mate 36.

FIG. 3 shows an exploded view of the five critical material components of our belt which are the front end-tab 20, the Velcro hooks 28, the Velcro loops 34, and the rear end-tab 32. Also, a buckle positioning hole 24 is shown.

Advantages

From the description above, a number of advantages of our belt fastening assembly becomes evident:

(a) The objective of pottie training is to ensure a child's ability to manage their bodily functions independently. The temporary adjustment of the child's clothing out of the way is an obvious requirement. This invention facilitates the objective by providing a means to unfasten the belt with a low level of dexterity.

(b) Many wetting accidents occur due to the level of dexterity required to open buckle-fastened belts. This invention provides a quick and easy means to unfasten a child's belt during these urgent times.

(c) Many daycare providers follow a Hands-Off policy regarding children and restroom use. This invention makes it easier to comply with applicable rules and regulations since children can unfasten their own belts independently.

(d) Many adults have special needs and require adaptive equipment to carry out their day-to-day lives. People with conditions limiting hand and wrist mobility including: severe arthritis, stroke victims, wearers of prosthetic hooks, among many others, can benefit from this invention.

(e) The present invention indeed has the appearance of a buckle-fastened belt. This fact allows the wearer to use the product discreetly.

Operation—FIGS. 1, 2 & 3

It is first of accepted that left strap-end 39 has been permanently attached to front end-tab 20, and, that right strap-end 40 has been permanently attached to rear end-tab 32, and, that torso-encircling strap 38 has been placed around the wearer's waist, through the trouser belt loops, in the way that apparel belts are commonly worn. With the fastening means now in front of the wearer's waist, the manner of using the present invention is as follows.

With one hand, the wearer or caretaker will lay said rear end-tab 32 flat against the front his or her torso, horizontally, with Velcro loops 34 facing away from the body. Using the other hand, the wearer or caretaker will lay said front end-tab 20 against said rear end-tab 32 in an overlapping fashion, with Velcro hooks 28 facing toward the body. Said front end-tab 20 is then pressed firmly against said rear end-tab 32 to engage said Velcro loops 34 and said Velcro hooks 28. This action completes the fastening operation.

Now, to unfasten the belt, the wearer or caretaker will locate front tab pull-grip 30 on said front end-tab 20. With one hand, the wearer or caretaker will grasp said front tab pull-grip 30 in any convenient manner. Generally, said front tab pull-grip 30 can be grasped between the thumb and index finger. The wearer or caretaker then pulls said front tab pull-grip 30 away from the body. This action separates said Velcro hooks 28 from said Velcro loops 34, thus, unfastening the belt.

Conclusion, Ramification, and Scope

Thus the reader will see that the belt fastening assembly of the invention provides a means by which those individuals who, for any number of possible reasons, have limited dexterity can open their belts quickly, easily, and independently. Those same individuals might well appreciate the fact that, while the above function is provided, the invention has the deceptive appearance of a regular, buckle-fastened, belt. This appearance allows the user to discreetly enjoy the benefits of this piece of adaptive equipment.

While our above description contains several specificities, these should not be construed as limitations on the scope of the invention, but rather as an exemplification of one preferred embodiment thereof. Many other variations are possible. For example:

(1) The Velcro hook and loop placement can be switched to the opposite end-tabs, i.e., the loops can be attached to the front end-tab and the hooks can be attached to the rear end-tab.

(2) A left or right hand version can be made by reversing the tab direction.

(3) The buckle can be omitted.

(4) The positioning holes can be omitted.

(5) A facsimile or ornamental buckle can be used.

(6) Other fastening materials such as magnets or a chemical adhesive can be used.

(7) The Velcro can be attached directly to a torso-encircling strap.

(8) The pull-grip can be omitted by covering the entire end tab with Velcro.

(9) The pull-grip can be formed by leaving the rear end-tab uncovered.

Accordingly, the scope of the invention should be determined not by the embodiments illustrated, but by the appended claims and their legal equivalents.

We claim:

1. A set of two apparel end-tabs for releasably fastening an apparel belt securely around the waist of a wearer comprising:

the belt includes free distal ends;

front and rear end tabs are each made of a strip of material that are defined by split top and bottom surfaces;

the top and bottom surfaces of the tabs forms a slit therebetween;

the free ends of the belt are positioned within the slit, respectively and the surfaces are permanently secured together;

the front and rear tabs includes corresponding hook and loop material;

the hook and loop material is positioned at least an inch inward from respective free edges of the tabs, which define front and rear pull-grips;

the front end-tab includes a plurality of decorative holes therethrough and a buckle with a tongue attached thereto;

the free edge of the front end-tab is inserted through the buckle with the tongue being positioned through one of the plurality of holes that is defined as a decorative simulated fastener;

the front and rear pull-grips of the tabs allows the belt to be adjustably worn about the waist.

2. A method of using a set of two apparel end-tabs for releasably fastening an apparel belt securely around the waist of a wearer comprising the steps of:

securing the belt which includes free distal ends being permanently positioned between respective slits that are formed through front and rear-end tabs;

providing the front and rear tabs with corresponding hook and loop material being positioned at least an inch inward from respective free edges thereof;

fastening the free edge of the front end-tab through a buckle with a tongue thereof being positioned through a decorative hole that defines a simulated fastener; positioning front and rear pull-grips of the tabs to be adjustably worn about the waist by attaching the corresponding hook and loop material together.

* * * * *